US006086471A

United States Patent [19]

Zimmermann

[11] Patent Number: 6,086,471

[45] Date of Patent: Jul. 11, 2000

[54] CASH REGISTER TERMINAL

[75] Inventor: Thomas Zimmermann, Berlin, Germany

[73] Assignee: F. Zimmermann GmbH & Co. KG, Germany

[21] Appl. No.: 09/141,982

[22] Filed: Aug. 28, 1998

[30] Foreign Application Priority Data

Sep. 3, 1997 [DE] Germany ..... 197 39 459

[51] Int. Cl.[7] ..... G07D 3/14

[52] U.S. Cl. ..... 453/3; 453/55; 453/56; 221/312 R; 222/199

[58] Field of Search ..... 453/3, 4, 7, 11, 453/55, 56; 194/206, 207, 217; 221/200, 281, 312 R; 222/199, 200

[56] References Cited

U.S. PATENT DOCUMENTS

| | | | |
|---|---|---|---|
| 4,545,509 | 10/1985 | Musschoot et al. | 222/199 X |
| 4,658,992 | 4/1987 | Peleus | 222/199 |
| 4,733,765 | 3/1988 | Watanabe | 453/3 X |
| 5,469,951 | 11/1995 | Takemoto et al. | 194/206 |
| 5,496,211 | 3/1996 | Zimmermann | 453/3 |

FOREIGN PATENT DOCUMENTS

| | | |
|---|---|---|
| 34 25 030 | 1/1985 | Germany . |
| 41 25 245 | 1/1993 | Germany . |

*Primary Examiner*—F. J. Bartuska
*Attorney, Agent, or Firm*—McGlew and Tuttle, P.C.

[57] ABSTRACT

A cash register terminal and process for operating a cash register terminal especially for self-service in gaming casinos, with bill-accepting and coin-deposition as well as coin-dispensing structure and with at least one coin box. To design the cash register terminal for high speed of operation and a large storage capacity for coins, the coins (17) are conveyed upward from the bottom from the coin box (2), of which there is at least one, and the coins (17) are dispensed above the at least one coin box (2), to at least one outlet (19, 20, 21).

11 Claims, 10 Drawing Sheets

Fig.7
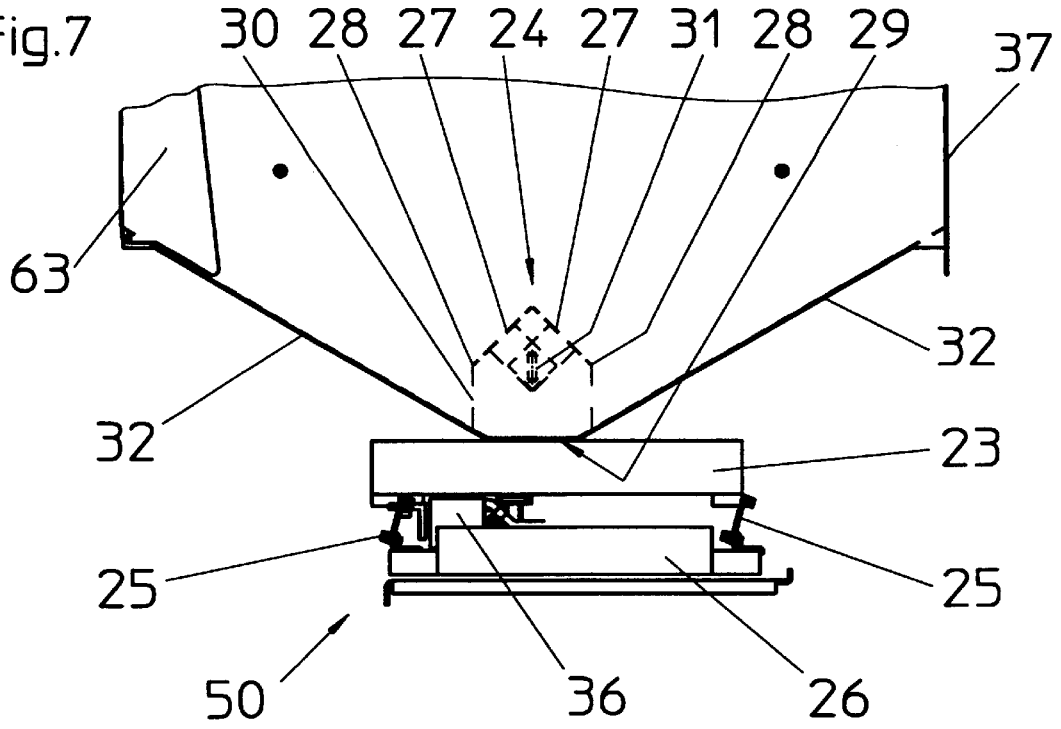
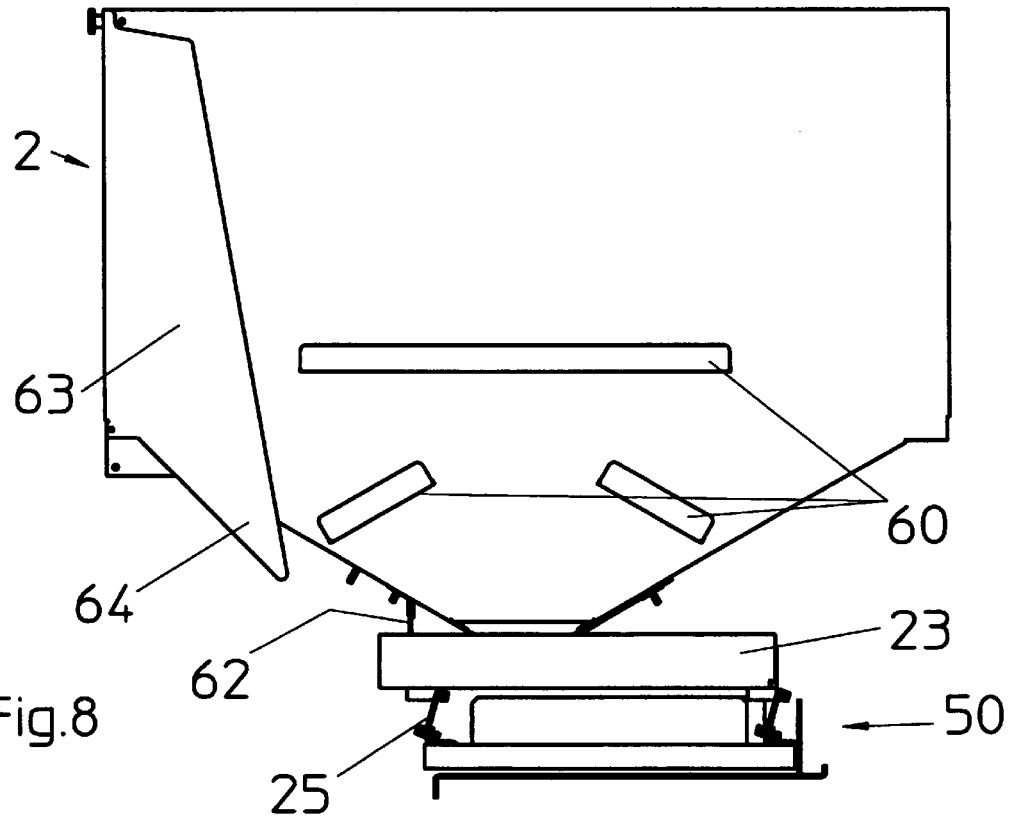
Fig.8

CASH REGISTER TERMINAL

FIELD OF THE INVENTION

The present invention pertains to a process for operating a cash register terminal and to a cash register terminal, especially for self-service for gaming casinos, with bill-receiving and bill-dispensing as well as coin depositing and coin-dispensing devices and with at least one coin box and further to a cash register terminal, especially for self-service in gaming casinos, with bill-receiving and bill-dispensing as well as coin-depositing and coin-dispensing device and with at least one coin box.

BACKGROUND OF THE INVENTION

Cash register terminals for self-service have been known in gaming casinos in the form of bill changers. The customer can change a bill into coins there. All other wishes of the customer, e.g., the changing back of coins, must be satisfied by the personnel manually and semiautomatically. The necessary manpower requirement in the casinos for the frequent filling of the bill changers with coins and the associated risk involved in the transportation of coins across the gaming casino, as well as the low speed of work and the small storage capacity of the bill changers set up for the coins are disadvantageous.

SUMMARY AND OBJECTS OF THE INVENTION

The primary object of the present invention is to provide a process for operating a cash register terminal and a compact, modular and ergonomically designed cash register terminal which can attain a high speed of work and large storage capacity for coins.

According to the invention, a process is provided for operating a cash register terminal, especially for self-service in gaming casinos, with bill-receiving and bill-dispensing as well as coin depositing and coin-dispensing means and with at least one coin box. The process includes conveying the coins from the bottom from a coin box, of which there is at least one, in the upward direction. The coins are dispensed above the coin box at at least one outlet.

According to another aspect of the invention, a cash register terminal, especially for self-service in gaming casinos is provided with bill-receiving and bill-dispensing as well as coin-depositing and coin-dispensing devices and with a coin box, of which there is at least one. A conveying device (coin elevator) is provided whereby the coins are conveyed from the bottom from the coin box in the upward direction. An outlet and a dispensing device are provided. The coins are dispensed above the coin box at at least one outlet.

By dispensing the coins above the coin box, the coins are delivered from bottom to top in a simple manner, so that the weight of the heavy coin container remains close to the floor. Due to the use of a coin elevator for the vertical delivery of the coins, a compact design and high speed of processing are reached. The equipment of the coin elevator with at least one outlet guarantees the performance of important functions of the cash register terminal, such as rapid and reliable processing of the coins.

The cash register terminal is provided with a large storage capacity for coins and it makes possible the circulation of the coins in the system for depositing and dispensing processes and a high speed of processing, as well as the changing of bills into coins and vice versa, wherein checking for authenticity and the return of counterfeit bills and coins is guaranteed.

An outlet at the end of the sorting section is used to fill the coins into boxes, such as filling bags or the like, on the rear side of the cash register terminal, which are not accessible to the customers. Via a coin shunt or a fourth outlet, this outlet may also be used to dispense coins to the customers on the front side of the cash register terminal. Another outlet is used to sort which remain in the cash register terminal, e.g., the remaining money during the changing of coins into bills by the customer. Yet another outlet is used to return coins to the sorting section for filling the coin box.

The coin box according to the present invention with deflecting plates is able, in conjunction with oscillating conveyors, to store a large amount of coins and to release them in small amounts in a reliable manner, and it guarantees a compact design. The coin box is emptied by means of the oscillating conveyors.

According to the present invention, the heavy coin boxes are arranged in the lower area of the cash register terminal beneath the coin-dispensing opening. The coins are conveyed upward for dispensing. As a result, the size of the coin boxes may be selected almost freely, so that a simple and convenient filling is possible. The statics of the entire cash register terminal is favorably affected by the center of gravity being shifted downward. The coin-dispensing opening is arranged at a convenient height for the user in an ergonomically favorable manner.

To prevent the cash register terminal from constantly going out of operation due to the coin boxes being full, circulation of the coins is provided for the depositing and dispensing of the coins. All depositing and dispensing processes take place from one coin box, so that coins received will also be returned to the customer from the same coin box. An equilibrium of the coins is thus established in the cash register terminal, so that interventions become necessary only occasionally, e.g., for maintenance or the like.

According to the present invention, coins are removed from the cash register terminal in the upper area of the vertical guide path with a very high level of accuracy by checking the preliminary decision made already in the upstream vertical guide path once again and making a final decision to leave the selected coin in the cash register terminal or to sort it out.

The introduction of the self-service cash register terminal in gaming casinos leads to the more rapid supply of the customers with coins and to the avoidance of waiting lines for changing coins back into bills due to the higher velocity of delivery. Higher safety is guaranteed and all requirements imposed on a functional self-service cash register terminal are met due to the automatic, mechanical recognition and rejection of counterfeit bills and coins. The rejection of counterfeit bills and coins is guaranteed even at high speeds of processing. With the cash register terminal according to the present invention intended for self-service in a modular design with user prompting via a user computer with a display with touchscreen,

- the assembly units can be replaced simply and rapidly for maintenance,
- comfortable operation via display with touchscreen is possible,
- bills can be changed into coins, coins into bills and bills into other bills,
- a plurality of types of coins can be processed,
- coins and bills are checked for authenticity and counterfeit coins and bills are returned to the customer,
- all transactions are stored and evaluated, additional cash register terminals may be integrated within a network, disturbances are recognized automatically and they lead to the cash register terminal being switched off.

The present invention will be explained in greater detail below on the basis of an exemplary embodiment of a cash register terminal with a coin elevator and a plurality of coin boxes, which is shown in the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 7 is a first embodiment of the coin box according to the invention;

FIG. 8 is a second embodiment of the coin box according to the invention;

DESCRIPTION OF THE PREFERRED EMBODIMENT

Figure 1:
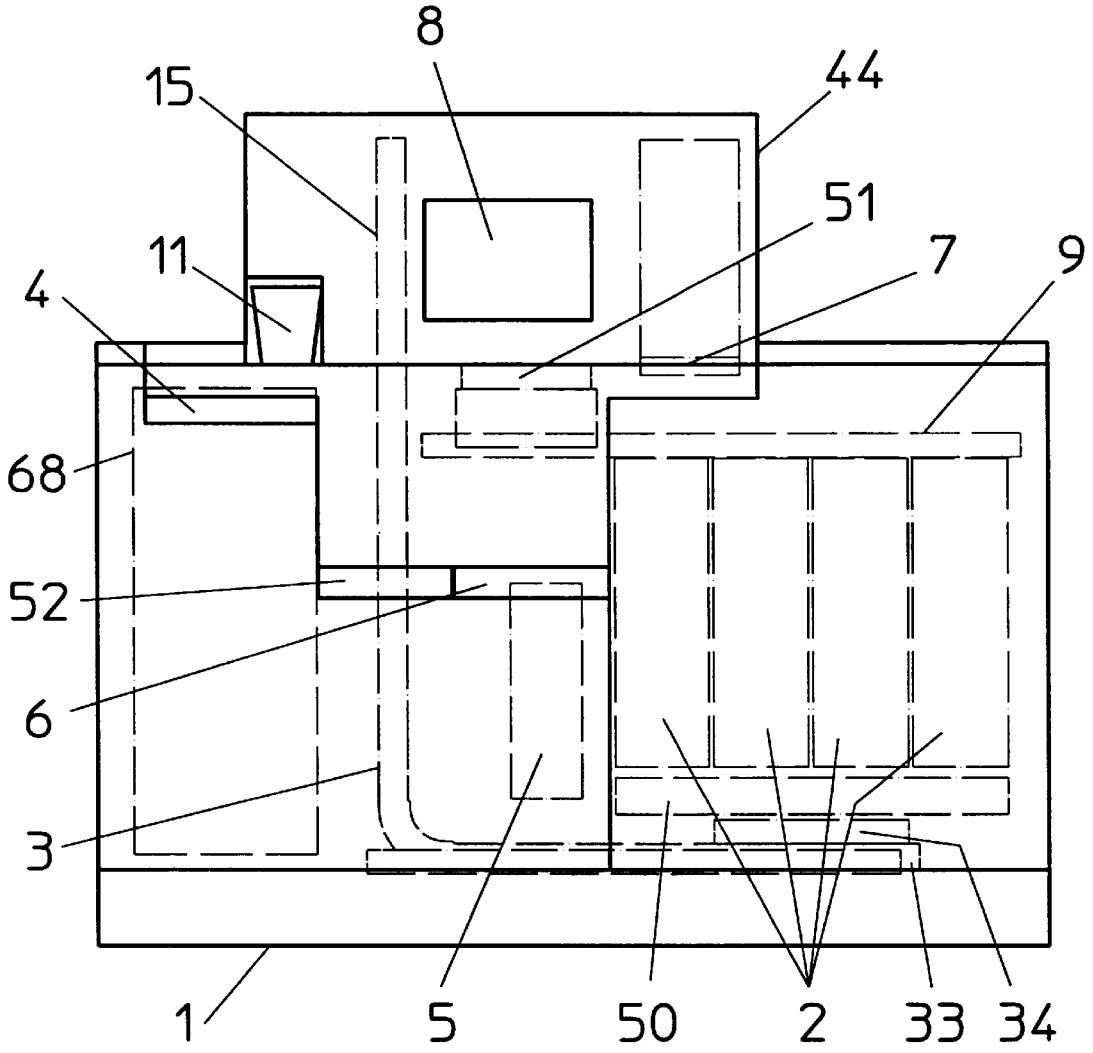
FIG. 1 is a front view of the cash register terminal according to the invention with assembly units drawn by broken lines.
Figure 2:
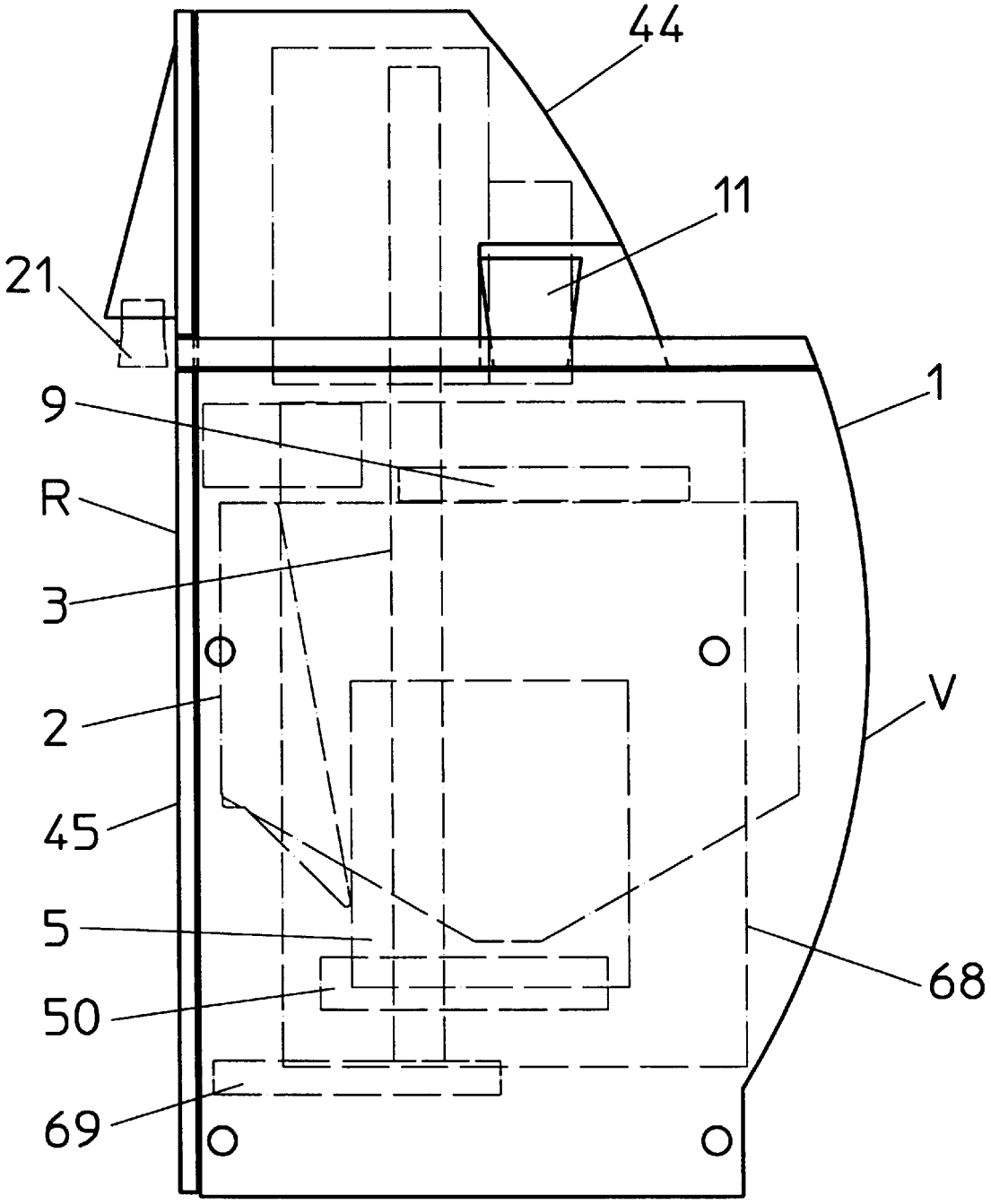
FIG. 2 is a side view thereof.
Figure 3:
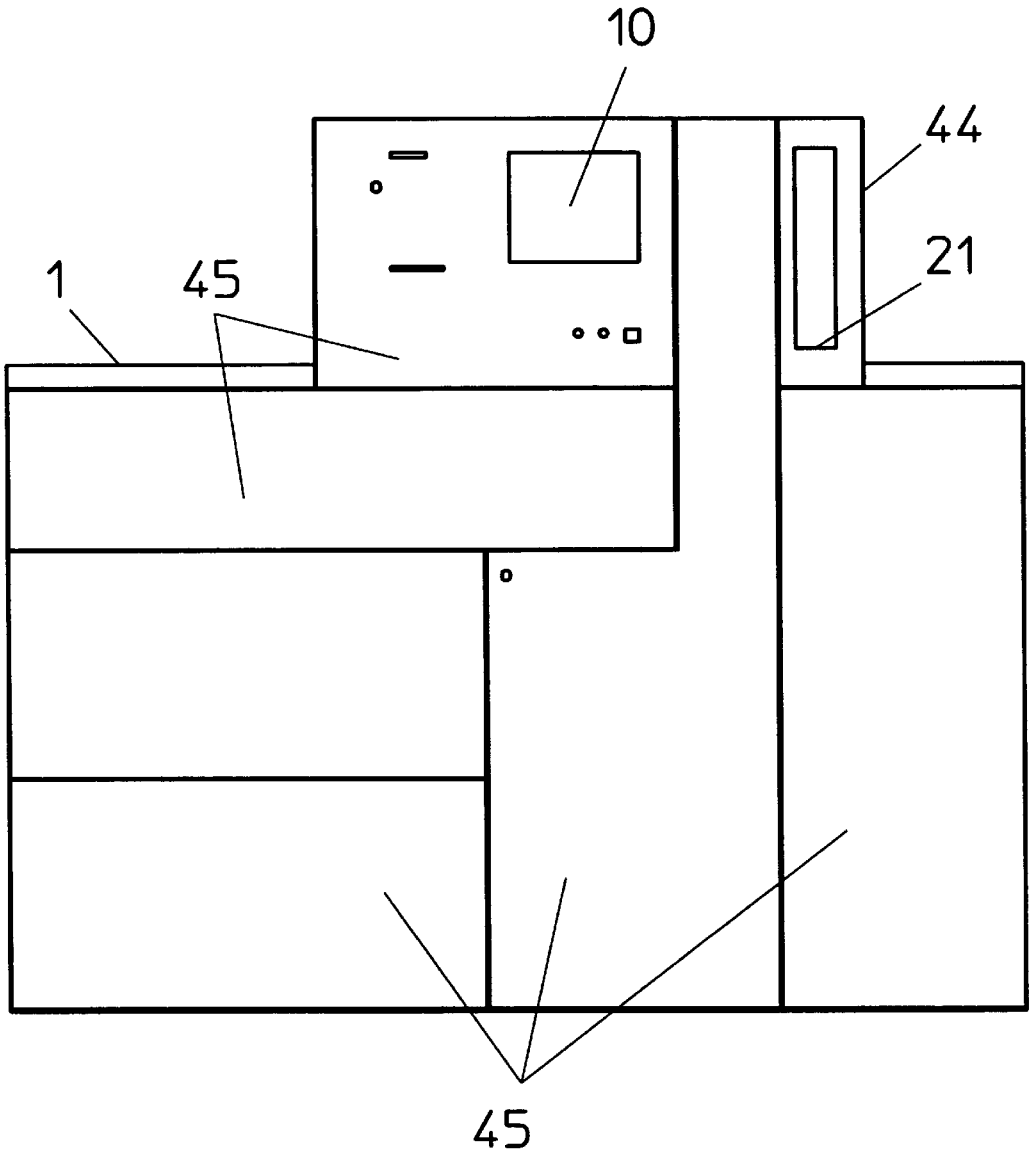
FIG. 3 is a rear view thereof.

Referring to the drawings in particular, the cash register terminal according to the representations in FIGS. 1 through 3 comprises a housing 1 bulging ergonomically forward in an arc-shaped manner on the front side V intended for the user with an attachment part 44, in which the assembly units important for the function are accommodated: These are four large coin boxes 2 on the right-hand side with an oscillating conveyor 50 arranged under them and a rotary table 34 for the coins 17; a small coin box 5 for intermediate sorting on the left next to the large coin box 2; a sorting drive 9 for coins 17 above the coin box 2; a coin elevator 3 with its horizontal coin delivery section 33 under the coin boxes 2, 5, and the vertical guide path 15 extending into the attachment part 44 of the housing 1 on the left next to the small coin box 5 and with a deflecting path 35 connecting the guide paths 15, 33; a coin cup 11 in the attachment part 44 on the left next to the upper end of the vertical guide path 15 of the coin elevator 3; a coin-receiving box 51 in the middle of the attachment part 44; a bill-receiving slot 7 on the right-hand side of the attachment part 44; a bill-coin dispenser 4 under and in front of the coin cup 1 at the upper end of a bill-processing device 68; a coin change box 52 and a foreign coin dispenser 6 in the center of the housing 1; a customer computer 8 with display and touchscreen in the middle on the front side V of the attachment part 44, as well as an office computer 10 for controlling all functions on the rear side R of the housing 1 shown in FIG. 1, on which a plurality of closable and pivotable doors 45 on the housing 1 and an outlet 21 for filling coins into bags are arranged.

Figure 4:
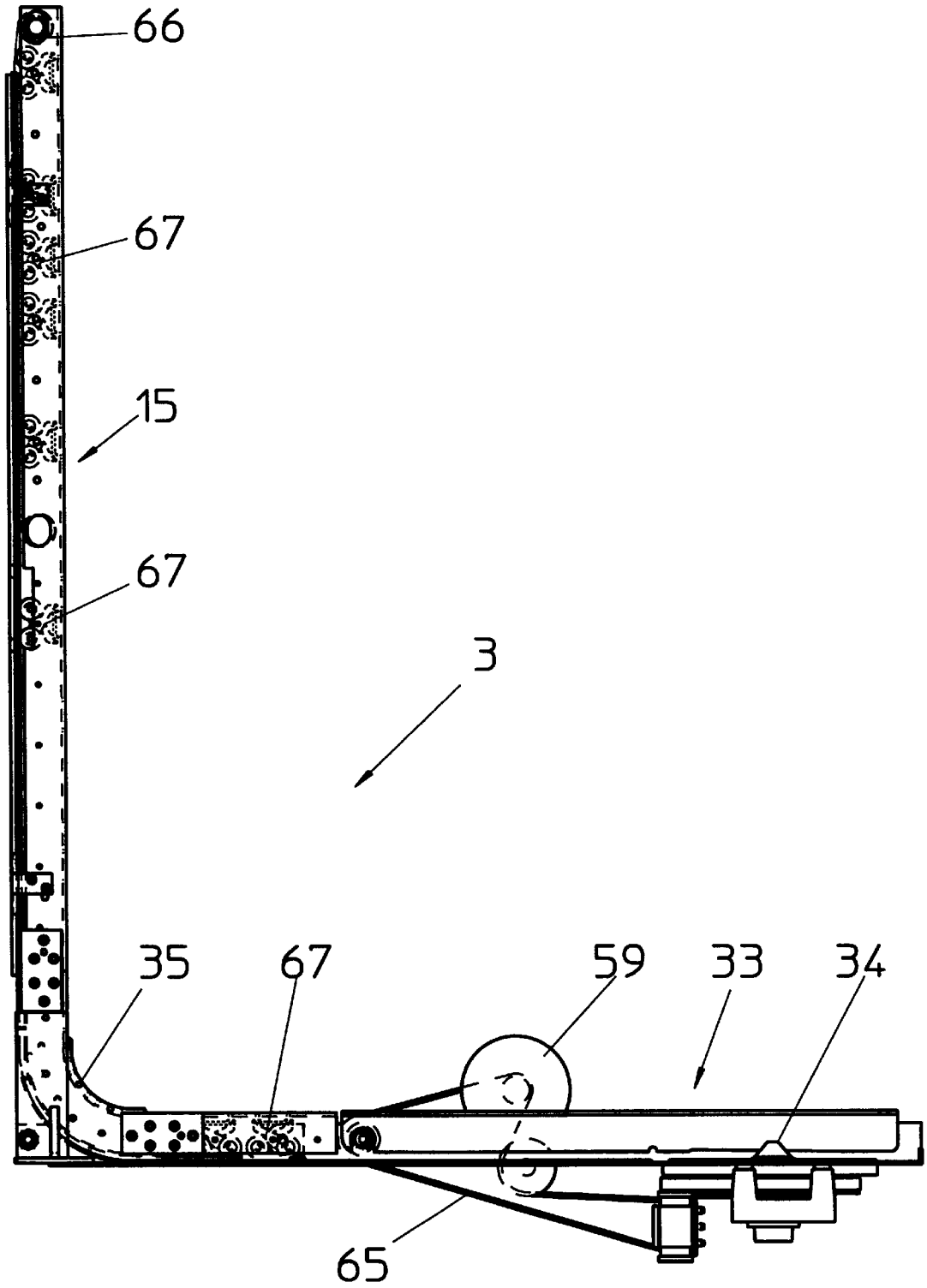
FIG. 4 is a front view of the coin elevator according to the invention.
Figure 5:
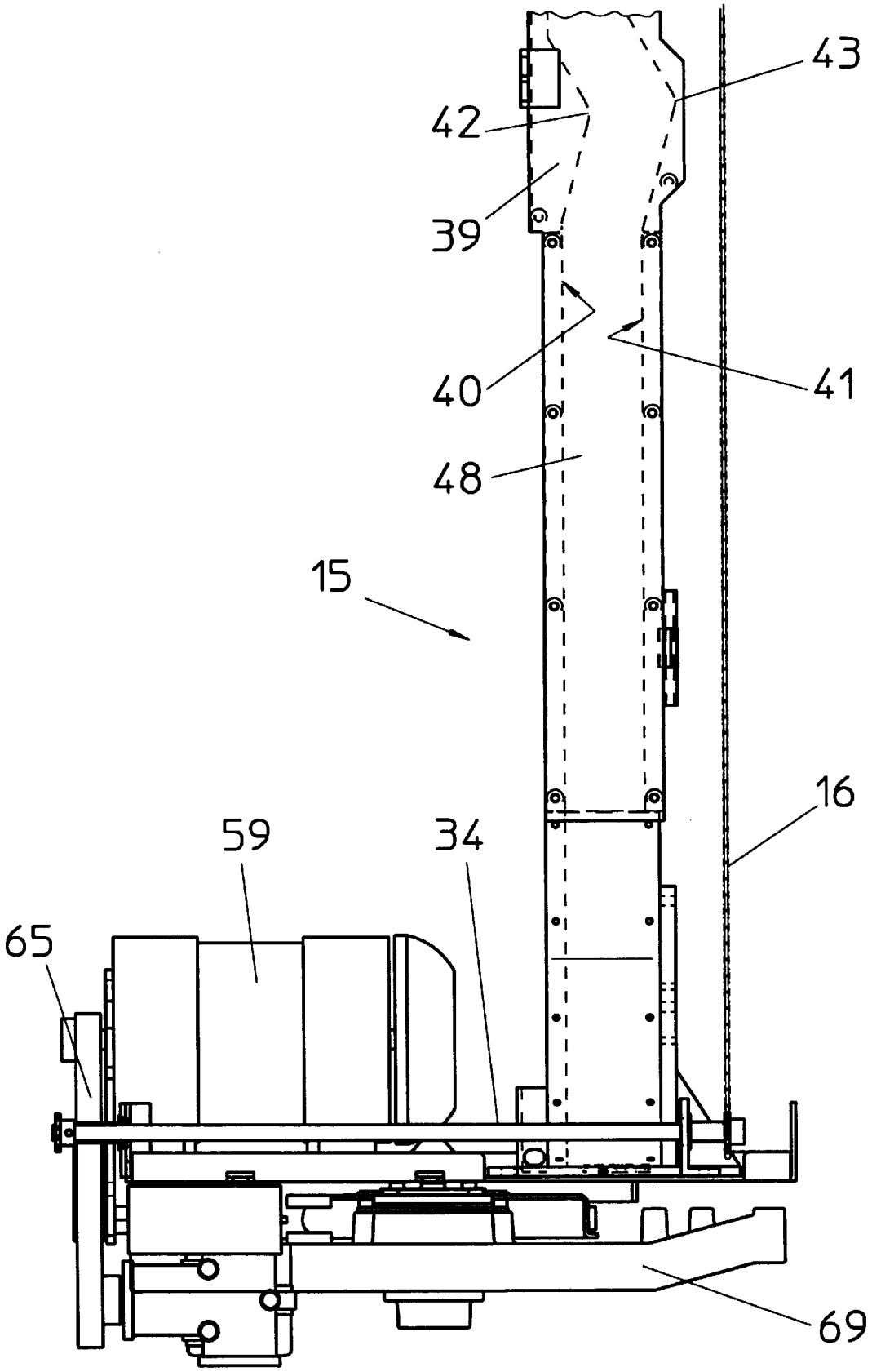
FIG. 5 is the side view of the lower part of the coin elevator according to the invention.
Figure 6:
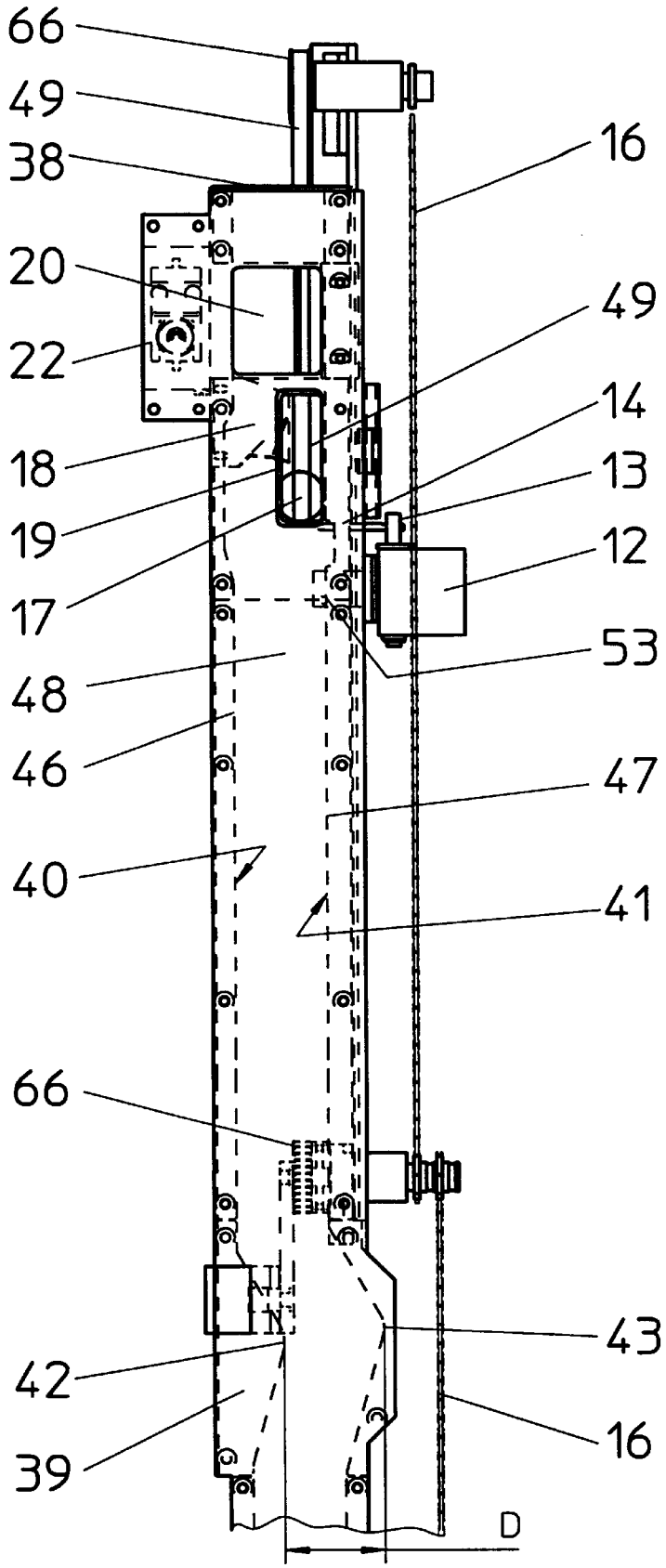
FIG. 6 is the side view of the upper part of the coin elevator according to the invention.

The coin elevator 3, comprising a horizontal and vertical guide path 33 and 15, respectively, will now be described in detail. The coins 17 arrive from a coin box 2 on a coin tray 23 (FIGS. 7 and 8), which is provided with an oscillation generator 36 and is arranged under the coin box 2, and from there on a rotary table 34 (FIG. 7) adjoining the coin tray 23, which is driven by means of a drive motor 59 via a belt drive 65, from there on the adjoining, lower, horizontal guide path 33 (FIG. 4), and on the vertical guide path 15 (FIGS. 4, 5 and 6) via a quadrant-like deflecting path 35 (FIG. 4). The horizontal guide path 33, the deflecting path 35 and the vertical guide path 15 consist of strip steel with guide rails 46, 47 attached on both sides, the distance between which is somewhat greater than the diameter of the largest of the coins 17 to be conveyed. Guides 48, whose inner edges are located at more closely spaced locations from one another than the distance between the inner edges of the guide rails 46, 47, are screwed onto the guide rails 46, 47. A C- or U-shaped guide channel 43 is thus formed for the coins 17 on the guide paths 15, 33 and the deflecting path 35, the guide rails 46, 47 and the guides 48. The guide channel 43 is formed between a left-hand guide edge 40 and a right-hand guide edge 41 (broken lines in FIGS. 5 and 6).

To make it possible to dispense the coins 17 via the outlets 19 and 20 (FIG. 6), it must be ensured that the coins 17 move at the right-hand guide edge 41 as a reference edge. This is brought about by a baffle plate 39 arranged in the vertical guide path 15. This baffle plate 39 is formed by bulges of the guide edges 40, 41 up to the outer edges 42, 43. The distance D between the outer edges 42, 43 of the bulges of the guide edges 40, 41, which outer edges 42, 43 are located in the area of the baffle plate 39, is selected to be such that the smallest coin 17 to be conveyed will be deflected to the right to the right-hand guide edge 41 acting as a reference edge, rather than being able to pass straight through the baffle plate 39. It is guaranteed as a result that the coins 17 are located at the right-hand guide edge 41. Due to the conveyor belt 49 being led slightly obliquely toward the right-hand guide edge 41 used as a reference edge, it is achieved that the coins 17 do not leave the right-hand guide edge 41.

Since the static friction between the conveyor belt 49 guided by deflecting rollers 66 and spring-loaded pressing rollers 67 and the coins 17 is stronger than the sliding friction between the coins 17 and the guide paths 33, 15 as well as the deflecting path 35, the coins 17 are guided at first nearly slip-free horizontally, then deflected into a vertical direction in the area of the quadrant-like deflecting path 35 and they are subsequently conveyed vertically upward along the vertical guide path 15, and problem-free vertical conveyance of the coins 17 up to the upper outlet 38 of the vertical guide path 15 and then to the outlet 21 (FIG. 3) on the rear side R of the cash register terminal for filling coins 17 into bags takes place because of the stronger static friction between the coin 17 and the conveyor belt 49 and the weaker sliding friction between the coin 17 and the guide paths 15, 33.

Recognition and counting of the coins 17 may be performed by means of a recognition and counting means, not shown, in the area of the lower, horizontal guide path 33, while the sorting and the dispensing of the coins 17 takes place in the area of the vertical guide path 15 (FIG. 4) in the coin elevator 3. The horizontal and vertical guide paths 33, 15 are of identical design. The conveyor belts 49 are driven by means of pulling by a chain drive 16 driven by the drive motor 59. Corresponding to the representation in FIG. 6, the vertical guide path 15 of the coin elevator 3 has a sorting device 12. A decision is made at this point individually for each coin whether it will remain on the guide path 15 or whether it will be sorted out via one of the outlets 19, 20, 38.

As soon as the recognition and counting means arranged in the horizontal guide path 33 has detected a coin 17 that shall not remain on the guide path 15, sorting out is ordered. After this coin 17 has passed by a second recognition means 53 in the vertical guide path 15, the sorting device 12 is activated, i.e., an electromagnet arranged in this sorting device 12 is excited, and this electromagnet moves a horizontal pin 14 into the guide path 15 of the coin 17 such that the coin 17 will be deflected from the guide edge 41 acting as a reference edge and thus from the guide path 15. The coin 17 tilts into the outlet opening 19 and is deflected by the coin-deflecting element 18 onto a chute, not shown, and it is returned onto the sorting drive 9 (FIG. 1) from there.

The coins 17 let through by the sorting device 12 are moved forward to the outlet 20 for the coin return and they can be delivered into a shaft there, which is opened or closed by a servodrive 22. The customer can remove the requested coins 17 from the shaft. When the coin return shaft is closed, the coins 17 are conveyed to the outlet 38 at the end of the vertical guide path 15 and removed via the outlet 21 (FIG. 3) and optionally returned into the slot machines of the casino. The outlet 21 is arranged on the rear side R of the cash register terminal (FIG. 3) and is not accessible to the customers. The emptying of the coin box 2, which becomes necessary, is performed from the rear side R of the cash register terminal by the operator via an operating console provided there. Coin types may also be selected and filled via this console.

If the depositing or dispensing of coins or bills is desired by the customer, all necessary commands are sent by the computer 8 for the customer and by the computer 10 for the office to the assembly units of the cash register terminal to perform the depositing or the dispensing.

In the case of the dispensing of coins 17, a bill is inserted by the customer into the bill-receiving slot 7 on the right-hand front side V of the attachment part 44. The desired type of coin is selected on the display of the computer 8 with the touchscreen. Coins 17 are then conveyed from one of the four coin boxes 2 by means of the associated oscillating conveyor 50 (FIG. 7) via the rotary table 34 onto the horizontal guide path 33 of the coin elevator 3. From this coin elevator 3, the coins 17 enter the coin cup 11 via the outlet 38 at the upper end of the vertical guide path 15. The coin elevator 3 is stopped according to the amount of coins selected and dispensed. The remaining change is returned in the case of depositing in a similar manner, the coins 17 being dispensed via the outlet 20.

The sorting device 12 (FIG. 6) is needed to let through to the outlets 20, 38 (FIG. 6) only the coins that are to be dispensed. This is necessary because the coin boxes 2 are open and not closable on one side and undesired coins 17 may enter the coin elevator 3 at any time. The coins 17 having unintendedly entered the coin elevator 3 are charged via the sorting device 12 onto the sorting drive 9 (FIG. 1) and are again sorted into the coin boxes 2 from there.

There are bottlenecks in prior-art self-service cash register terminals due to the storage capacity of the coin boxes 2, which are often emptied too rapidly or are overfilled and interfere with the operation, being too small. Due to the special design of the four large coin boxes 2 (FIG. 7) and of the area in which the coins 17 are taken over from the rotary table 34 onto the lower guide path 33 of the coin elevator 3, as well as due to the coin boxes 2 being arranged in the lower area of the cash register terminal, it is achieved that the coin boxes 2 can receive a sufficiently large amount of coins and thus guarantee the reliable operation of the cash register terminal. Due to the center of gravity being shifted into the lower area of the cash register terminal, the size of the coin boxes 2 may be selected almost freely.

FIG. 7 shows a section of the lower area of the coin box 2 in the first embodiment with the coin outlet 29 onto the coin tray 23 and the connection to the coin tray 23. The coin box 2 is designed to accommodate and dispense a larger amount of coins 17 with a heavy weight. The coin box 2 is emptied by means of the oscillating conveyor 50. For conveyance by means of oscillation generators 36, a counterweight is usually needed for the weight of the coin box 2, including the coins 17 contained therein, which counterweight is higher than the weight of the coin box 2 and the coins 17 contained therein. To make possible a compact design, the weight of the coins 17 and of the coin box 2 can be compensated to minimize the counterweight while guaranteeing the full functionality of the oscillating conveyor 50.

To compensate the weight of the coins, a roof-shaped deflecting plate 24 is arranged in the coin box 2 such that its side plates 27, which are arranged essentially rectangularly to one another, are located with their free front sides 28 outside the bottom outlet of the coin box 2 formed by the coin outlet 29, as is indicated by the broken line 30 (FIG. 7). The pressure of the coins is laterally compensated as a result and shifted to the side walls 32, 37 of the coin box 2. The coin tray 23 located under the coin outlet 29 and the bottom opening of the coin box 2 is relieved. In the case of a defective oscillation generator 36, the coin box 2 can be opened by folding down a front-side side wall 37 or door 63, so that convenient removal of the coins 17 is possible.

The deflecting plate 24 is adjustable by means of an elongated hole 31 and is set at a distance d from the bottom opening 29 of the coin box 2, which is at least twice the largest diameter of the coins 17 located in the coin box 2. Wedging of the coins 17 in the coin outlet funnel formed from the oblique surfaces 32 of the coin box 2 is thus prevented.

The coin tray 23 is shaken via the oscillation generator 36 and via vibratory spring elements 25 independently from the coin box 2. Due to the deflecting plate 24 being arranged in the coin box 2 and the compensation of the coin weight thus achieved, it is achieved that the necessary counterweight 26 under the coin tray 23, which counterweight is rigidly connected to the housing, needs to have a substantially smaller weight than the filled coin box 2. The counterweight 26 is connected to the chassis 69 via rubber buffers 51.

It is very important in the case of a cash register terminal for operating errors not to lead to the cash register terminal going out of operation. To avoid jamming due to the insertion of foreign objects, such as crown caps or the like, the rotary table 34 of the sorting drive 9 (FIG. 5) is equipped with a flap mechanism, not shown in this embodiment. The rotary table 34 is emptied via the flap mechanism and its contents, containing foreign objects, are returned to the customer into the coin return compartment 6 (FIG. 1).

The assembly units installed in the cash register terminal for processing coins and bills may be used equally for the customer area on the front side V (FIG. 1) and for the operator area on the rear side R (FIG. 3) of the cash register terminal. The operator of the cash register terminal can perform the emptying of the cash register terminal from the rear side R without interfering with its ability to function during ongoing operation on the front side V accessible to the customer (FIG. 1). The customer area has priority. The emptying process of the coin boxes 2 is interrupted when a customer requests coins 17 on the front side V from the box 2 just being emptied. The customer's request is delayed only briefly, namely, until the emptying process is interrupted and the priority of the customer's request has become effective.

The possibility of returning the amount of cash inserted by the customer into the cash register terminal is provided for checking purposes in an embodiment of the present invention. The customer can initiate the return of the coins 17 inserted by him on the touchscreen of the computer 8 in order to check, e.g., the counting performed and the display of the amount of cash on the display of the computer 8 by repeating the process. To do so, the small coin box 5 next to the large coin box 2 is provided in the representation in FIG. 1 with a dropout opening in the bottom, not shown. The coins 17 inserted by the customer drop onto the sorting drive 9 and are conveyed into the coin box 5 via a special sorting opening after the counting process. If the customer does accept the amount of cash displayed on the display of the computer 8 by touching a corresponding key, the bottom flap in the small coin box 5 is opened, and the coins 17 drop onto the horizontal guide path 33, on which they are conveyed upward onto the sorting drive 9 via the vertical guide path 15 and are sorted into the coin boxes 2 from there.

If the customer does not accept the amount displayed on the display of the computer 8 by touching a corresponding key, the coins 17 are ejected from the coin box 5 onto the horizontal guide path 33 and are conveyed upward into the cup 11 via the vertical guide path 3 from there.

Figure 9:
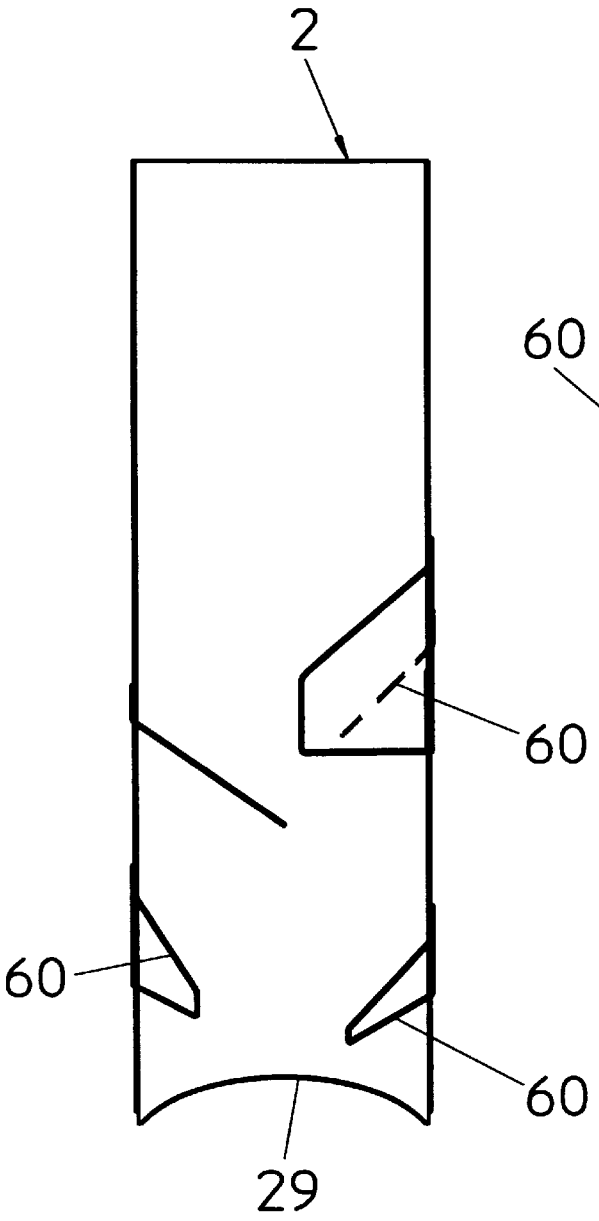
FIG. 9 is a front view of the coin box according to FIG. 8.
Figure 10:
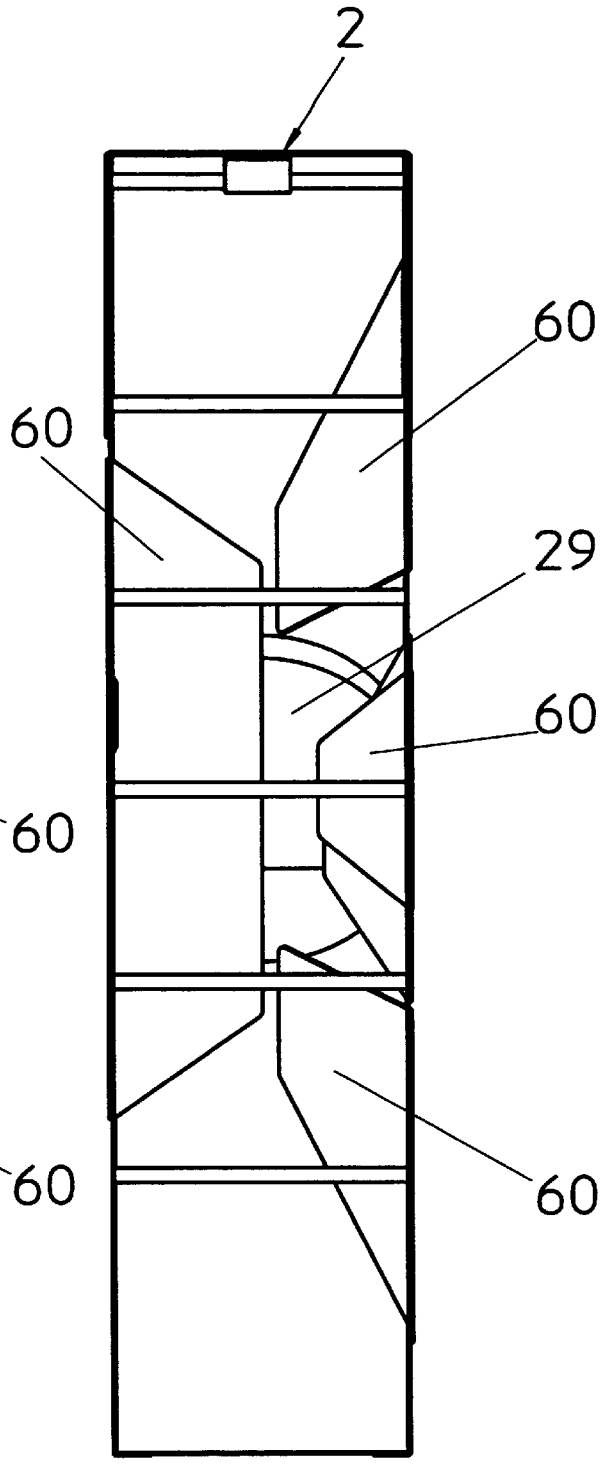
FIG. 10 is a top view of the coin box according to FIG. 8.

FIGS. 8, 9 and 10 show an alternative embodiment of the large coin box 2, in which the roof-shaped deflecting plate 24 according to FIG. 7 is replaced with a plurality of oblique deflecting plates 60, which are passed through slots in the side walls 61 of the coin box 2 from the outside and are welded to the side walls 61, so that there are no screw connections hindering the flow of coins on the inside of the coin box 2. The individual deflecting plates 60 have various shapes according to FIGS. 8, 9 and 10 and are always directed obliquely downward toward the coin outlet 29. The oblique deflecting plates 60 are used to support the weight of the coins 17 located in the coin box 2 in order to prevent the coins 17 from being jammed, such as forming bridges. The coin outlet 29 proper has an arc-shaped or round design, as is shown in FIG. 9. This brings about a favorable flow of the coins 17 onto the coin tray 23, which is located under the coin box 2, with the oscillating conveyor 50.

FIG. 8 shows a rubber flap 62, which hangs down freely on the left next to the coin outlet 29 and is used to guide the coins onto the coin tray 23. A door 63, which can be pivoted around an essentially horizontally arranged axis located in its lower area in order to make it possible to reach into the coin box 2 for eliminating jamming, is also arranged on the left-hand side of the coin box 2 as shown in FIG. 8. An attachment 64 of the door 63, which attachment extends downward in FIG. 8, is used to prevent the coins 17 from falling out on opening the door 63.

Figure 12:
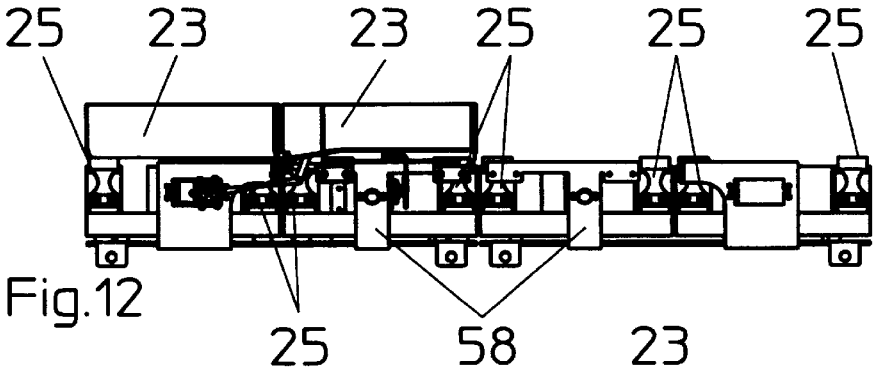
FIG. 12 is a front view of the oscillating conveyors according to FIG. 11.
Figure 11:
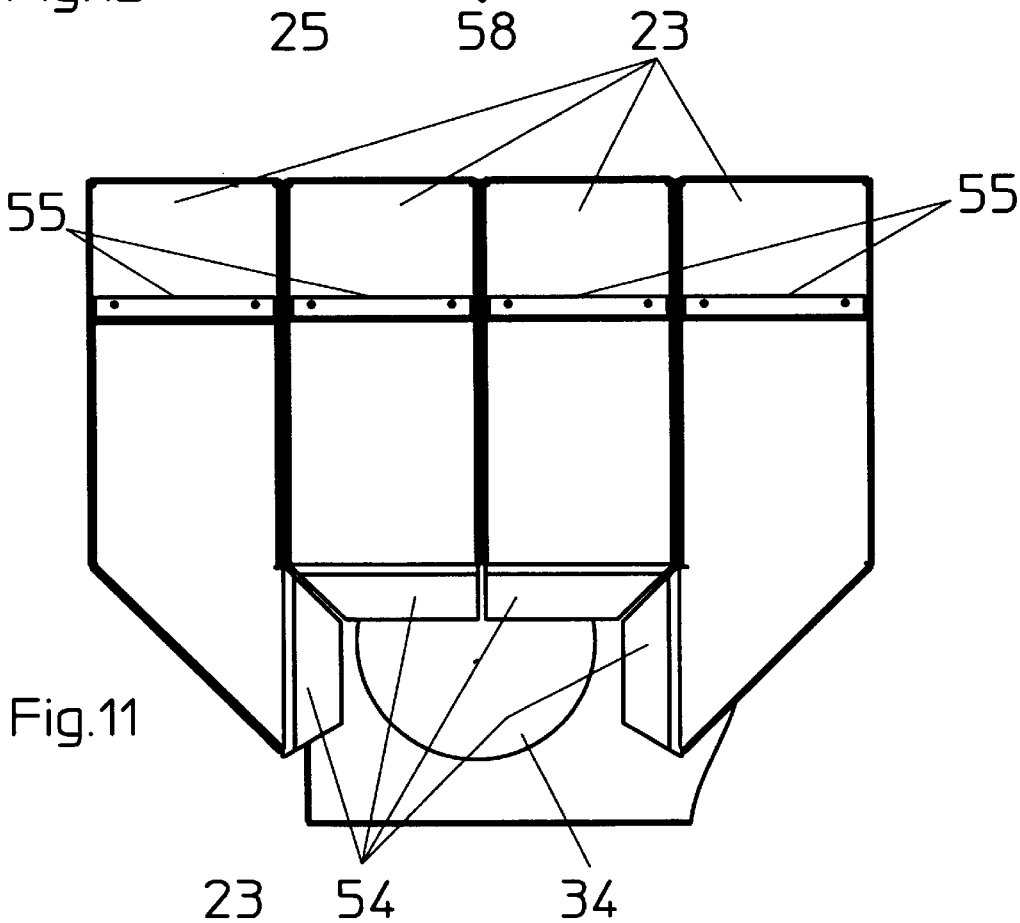
FIG. 11 is a top view of the oscillating conveyors located under the coin boxes according to the invention.
Figure 13:
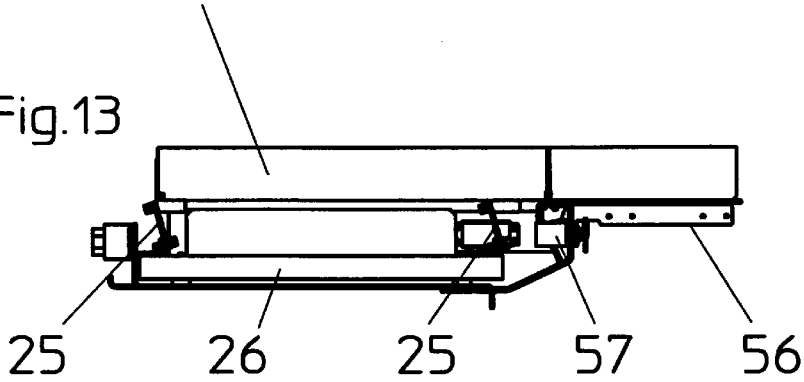
FIG. 13 is a side view of the oscillating conveyors according to FIG. 11.

FIGS. 11 through 13 show the oscillating conveyor 50 located under the coin box 2 with the associated coin trays 23 and with flaps 54, which are associated with the said coin trays and surround the rotary table 34 of the coin elevator 3 located under them in a U-shaped pattern. The coin trays 23 arranged under each coin box 2 are covered by angle plates 55 on the rear side of the housing 1. The oscillation generators 36 of the respective coin trays 23, which are articulated to the counterweight 26, which is a rigid part of the housing, via the vibratory spring elements 25 (FIG. 13) and rubber buffers with spring elements, are arranged under the coin trays 23. The flaps 54, which are associated with each coin tray 23, which can be vibrated, are mounted on hinges 56 which are rigidly attached to the housing and are pivotably mounted by means of servodrives 57 arranged rigidly on the housing. The flat flaps 54 arranged on the free outlet side of the respective vibrating coin tray 23 are used to prevent coins 17 from flowing out of the actually vibrating coin tray 23 due to the flaps 54 themselves being mounted rigidly on the housing via the hinges 56 independently from the vibrating coin tray 23. The corresponding flap 54 is folded down by means of the servodrive 57 to bring about the flow of coins onto the rotary table 34 only to empty the respective vibrating coin tray 23 onto the rotary table 34.

FIG. 12 additionally shows the clamps 58 arranged between the respective hinges 56 of each flap 54 to hold the respective flap 54.

Figure 14:
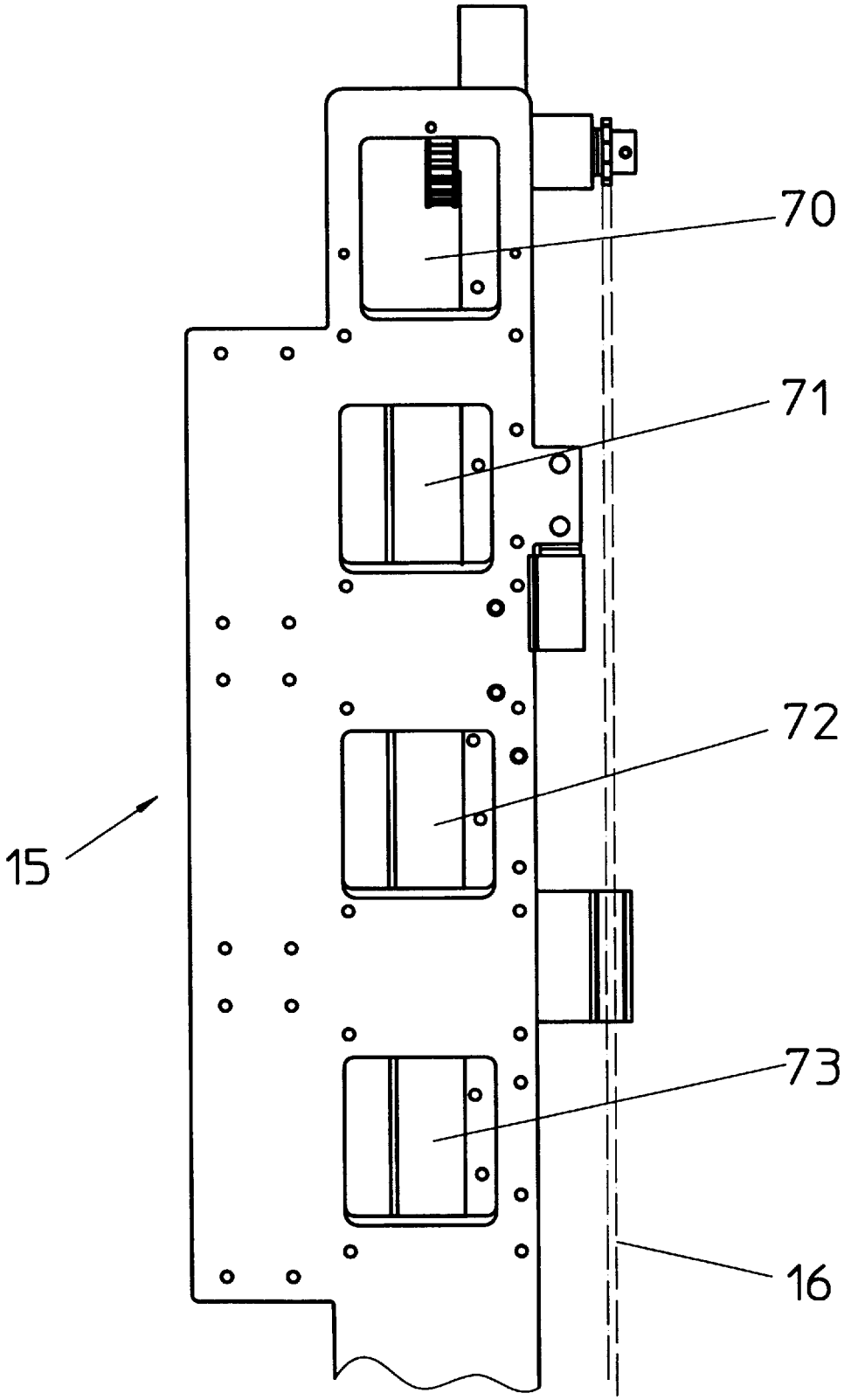
FIG. 14 is a view of the upper part of the coin elevator in a modified form compared with that shown in FIG. 6.

FIG. 14 shows an alternative embodiment of the upper end of the vertical guide path 15 of the coin elevator 3. A total of four outlets 70 through 73 are arranged here, of which the upper outlet 70 leads to the outlet 21 for filling the coins 17 into bags on the rear side R of the housing 1, while the next outlet 71 guides the coins 17 to the coin cup 11 on the front side V of the housing 1, and the outlet 72 located under it guides the coins 17 to the sorting drive 9, and the lowermost outlet 73 guides the coins 17 to the change dispenser 52.

While specific embodiments of the invention have been shown and described in detail to illustrate the application of the principles of the invention, it will be understood that the invention may be embodied otherwise without departing from such principles.

What is claimed is:

1. A cash register terminal comprising:

bill-receiving and bill-dispensing as well as coin-depositing and coin-dispensing devices;

a coin box;

an outlet dispensed above said coin box dispensing the coins;

a conveying device conveying coins from a bottom of the coin box in an upward direction, said conveying device including a coin elevator arranged with a horizontal guide path under said coin box and with a vertical guide path adjacent to said coin box whereby the coins are dispensed at said outlet above said coin box;

computer means for controlling functions of all assembly units, said coin elevator comprising one of said assembly units, wherein said coin-depositing and coin-dispensing devices include at least one coin recognition means, said coin-depositing and coin-dispensing devices being connected to said horizontal and vertical guide paths via said coin elevator and being connected to one another via the coin box, said coin box being arranged under a coin outlet in a lower area of the cash register terminal and being common for all depositing and dispensing processes, said coin elevator including a plurality of sorting devices for vertically conveying and sorting out individual coins in said vertical guide path for deciding about the fate of the coins, a coin outlet for dispensing coins to a user, and a sorting means for sorting the said remaining coins.

2. The cash register terminal in accordance with claim 1, wherein said coin box has at least one deflecting plate and a coin tray arranged under it, said coin tray being provided with an oscillating conveyor.

3. The cash register terminal in accordance with claim 2, wherein said deflecting plate is arranged in said coin box above said coin outlet opening at a distance (d) that is at least twice the diameter of a largest coin present in said coin box, said deflecting plate having front sides located outside a coin outlet opening of said coin box.

4. The cash register terminal in accordance with claim 3, wherein said deflecting plate is mounted so as to be adjustable in height in said coin box.

5. The cash register terminal in accordance with claim 4, further comprising a screw connection cooperating with an elongated hole, said screw connection for adjusting said distance (d) of said deflecting plate from said coin outlet.

6. The cash register terminal in accordance with claim 2, wherein a plurality of said deflecting plates are provided in said coin box arranged at side walls at different levels, directed obliquely downward toward said coin outlet.

7. The cash register terminal in accordance with claim 1, wherein said sorting device contains deflecting elements arranged vertically and horizontally in said guide path of said coins, said deflecting elements being rotatable by means of magnetic force, and via which predetermined coins are deflected into said coin outlet.

8. The cash register terminal in accordance with claim 7, further comprising a baffle plate for guiding coins to a right-hand guide edge acting as a reference edge is arranged in front of said sorting device in the said vertical guide path.

9. The cash register terminal in accordance with claim 8, wherein said coin box, said coin elevator and other components of the cash register terminal are assembly units provided for the processing of coins and bills and are used for both the customer area on the front side of the cash register terminal and the operator area on the rear side of the cash register terminal, wherein the customer area is separated in space from the operator area.

10. The cash register terminal in accordance with claim 1, further comprising;

a sorting drive; a small coin box in functional connection with said sorting drive, a coin cup and said coin box via said horizontal guide path and said coin elevator in order to make possible the return of an amount of coins deposited for checking purposes, said small coin box being provided next to said coin box.

11. The cash register terminal in accordance with claim 1, further comprising: a housing; a servo drive; a flap mounted as a rigid part of said housing, and being actuated via said servodrive; a coin tray arranged under said coin box and provided with an oscillating conveyor and being associated with said flap; and a rotary table located under said coin tray, said flap for transferring the coins from said coin tray onto a rotary table.

* * * * *